United States Patent [19]

Linz et al.

[11] 4,101,225

[45] Jul. 18, 1978

[54] APPLICATOR, ESPECIALLY FOR PIGMENTED LIQUIDS

[76] Inventors: Friedrich Linz, No. 97, D-8561 Hirschbach; Lothar Sommer, Kurlandstrasse 24, D 8500 Nüremburg-Katzwang, both of Fed. Rep. of Germany

[21] Appl. No.: 751,020

[22] Filed: Dec. 16, 1976

[30] Foreign Application Priority Data

Dec. 17, 1975 [DE] Fed. Rep. of Germany ... 7540155[U]

[51] Int. Cl.[2] ..... A46B 11/00

[52] U.S. Cl. ..... 401/119; 401/126

[58] Field of Search ..... 401/118–130, 401/191, 265, 267, 262, 292

[56] References Cited

U.S. PATENT DOCUMENTS

| | | | |
|---|---|---|---|
| 2,245,906 | 6/1941 | Deakers et al. | 401/126 |
| 3,246,657 | 4/1966 | Roller, Sr. | 401/119 |

*Primary Examiner*—Stephen C. Pellegrino
*Attorney, Agent, or Firm*—Marn & Jangarathis

[57] ABSTRACT

The invention relates to an applicator, especially for pigmented liquids, including a container for the liquid, open at one end, but closable by means of a handle which can be fitted on its open end. The handle element carries a shaft and on the free end thereof is provided an overhanging capillary applicator tip. In order to ensure, on the one hand, in such an instrument, a reliable feed of the applicator tip with the liquid and, on the other hand, to prevent an unintentional emergence, especially splashing, of liquid when the instrument is open, it is proposed, according to the principle of the invention, to close the liquid container by means of an inset element, which has transverse slots forming capillary channels, which slots on the one hand reliably convey the liquid to the applicator tip and, on the other hand, prevent excessive issue of liquid.

8 Claims, 6 Drawing Figures

APPLICATOR, ESPECIALLY FOR PIGMENTED LIQUIDS

The invention relates to an applicator, especially for pigmented liquids, which comprises a container for the liquid, open at one end, but closable by means of a handle which can be fitted on its open end, the handle element carrying on the front end face, which in the closed position bears against the liquid container, an applicator tip projecting into the liquid container and having capillary channels, the applicator tip being guided in a shaft connected with the handle and overhanging the shaft at its free end.

In applicators of this kind, which are for example used for cosmetics, there are two problems. On the one hand, it must be reliably ensured that liquid cannot issue under normal conditions from the liquid container even in the event of careless handling. On the other hand, it is also essential that the applicator tip can be sufficiently wetted by the liquid in the container when the handle with the applicator tip is fitted onto the liquid container.

In a known applicator instrument, the open end of the liquid container carries a connector piece which by virtue of its shaping is intended to prevent emergence of liquid from the applicator even when the latter is stored lying on its side or is shaken. For this purpose, the connector piece of the known applicator has a liquid outlet orifice which is only relatively small for example having a diameter substantially corresponding to the diameter of the applicator tip. However, in spite of the presence of this small outlet orifice, the emergence of liquid cannot always be prevented. In the known applicator, this liquid then passes into the space surrounding the shaft within the connector piece and soils the shaft, which makes the handling of the instrument more difficult. It has been found, in particular, that liquid emerges to an excessive degree from the liquid container in the case where the handle, carrying the shaft and applicator tip, is repeatedly fitted on and removed, without the liquid which adheres to the applicator tip being consumed in the interim. This is probably attributable to the fact that the tip, on each insertion into the orifice of the liquid container, sucks liquid from the container due to the resulting capillary effect. It has been further found that, in the known applicator, liquid emerges from the container when the applicator is exposed to elevated temperatures, for example due to exposure to the heat of the sun, since in this case the pressure in the liquid container increases and the liquid, which frequently contains highly volatile substances, can be expelled out through the small orifice.

In the known applicator, it has been attempted to ensure reliable feed of the liquid from the container to the applicator tip by means of specially designed, relatively complicated parts. This, however, gives rise to the disadvantage that the manufacture and the fitting of these parts, for example mushroom-shaped sintered elements, in the liquid container causes difficulties. In addition, the presence of the parts effecting the conveying of the liquid makes it impossible to achieve a better sealing of the liquid container against undesirable emergence of liquid.

It is therefore the object of the invention to design an applicator of the type mentioned at the outset, in such a manner that on the one hand feed of the required quantity of liquid to the applicator tip is reliably achieved and, on the other hand, the liquid container is securely sealed against undesired emergence of liquid.

According to the present invention, we provide an applicator including a container open at one end; a handle adapted to be fitted on the open end of the container to close it; an applicator tip on that end of the handle which in the closed position of the applicator faces the container, said applicator tip being adapted to project into the container and having capillary channels, and also being guided in a shaft connected with the handle and projecting from the free end of this shaft; and an inset element in the container at said open end of the container, said inset element having an approximately central recess for accommodating the front end of the applicator tip in the closed position, and being provided with at least one transverse slot which extends in the axial direction and forms capillary channels which connect the interior of the container with said recess for the front end of the applicator tip, whereby a liquid product in the container will enter said capillary channels and be guided into communication with said applicator tip.

Owing to the presence of the transverse capillary channels and the recess for the front end of the applicator tip, the container is reliably protected against undesired egress of liquid, for example due to careless handling. The liquid remains in the capillary channels and cannot emerge therefrom even if the liquid container is tipped over. In consequence, reliable sealing of the outlet is achieved in a very simple manner. Furthermore, the transverse capillary channels reliably achieve conveying of liquid from the container to the recess and thus to the applicator tip, provided care is taken to ensure that the liquid present in the liquid container passes to that end of the transverse slot or slots which is oriented towards the interior of the container. However, this may for example only require that the applicator is laid in a horizontal orientation which, for example in an applicator instrument for cosmetic liquids, necessarily occurs when this instrument is accommodated in a bag or other container. Even if the applicator were not tilted during normal handling, no difficulties would arise in priming the applicator tip with liquid, because for this purpose the applicator need only be held in the horizontal position for a short time.

Thus, with the applicator according to the invention, there is achieved both reliable sealing of the liquid container against undesirable emergence of liquid and also an adequate and reliable supply of liquid to the applicator tip.

The sealing of the container can be further improved if the transverse slots and the recess are formed in an inset element in the open end of the container, preferably an inset element of which consists of a closure piece made of elastically deformable material such that when the front end of the shaft of the applicator tip is inserted in the central recess the transverse slots, of a normally closed type can be expanded by the shaft end. A closure piece of this kind makes the egress of liquid impossible even in the event of the container being thrown about or dropped while the handle is removed.

It has further proved advantageous to provide the inset element, on its side facing towards the bottom of the liquid container, with an annular gap extending approximately concentrically to its axis and communicating with said at least one transverse slot, the gap having capillary dimensions relative to the viscosity of the liquid to be stored in the container. The annular gap is preferably bounded by a peripheral groove of the inset element open to the bottom of the container and by the inner wall of the container itself. Thus, especially with the last-mentioned construction of the annular gap, said at least one capillary transverse slot can be reliably supplied with liquid even in the case where only an extremely small quantity of liquid is present in the liquid container. Moreover, by means of the annular gap, uniform application of liquid is achieved over the entire periphery of the inset element.

In spite of the presence of the inset element, passage of the liquid into the space surrounding the shaft of the applicator tip, and consequent soiling of the shaft cannot be always excluded. This can however be reliably ensured if a collar is provided on the open end of the liquid container the collar bearing sealingly on the shaft in the vicinity of its free end, when the applicator is closed. Thus, even if liquid should issue through the inset element due to special circumstances, it can only get as far as that end of the shaft where the applicator tip is located. By contrast, the collar prevents the remaining portion of the shaft from being soiled by the pigmented or other liquid. The shaft thus remains clean, and there is no risk of soiling during use of the applicator.

A particularly simple design of the collar results when it is formed by an approximately cylindrical inner wall section of a connector piece serving to connect the handle and the container, and projecting from the container at its open end. In general, both the shaft and the connector piece are made of plastics material so that, on the one hand, the cylindrical inner wall section can be easily fitted to the connector piece and, on the other hand, the dimensions of shaft and inner wall section can easily be so selected that a perfect seal is achieved between the shaft and the inner wall section when the shaft is inserted. Experiments have shown that, depending on the material, a difference in diameter between the shaft external diameter and the internal diameter of the inner wall section of about 0.2 to 0.5 mm ensures both a perfect seal and ease of operation.

Another possibility for producing the collar consists in fitting into a connector piece which serves to connect the handle and the container, a collar provided with a sealing and wiper lip oriented towards the shaft, the collar being made of elastically deformable material. In this case, by selecting a correspondingly soft material for the collar, an even better sealing effect and also even easier insertion and withdrawal can be achieved.

The inner space of the connector piece preferably tapers approximately conically from the collar to the storage space for the liquid in the container, and terminates in an orifice connecting the inner space with the storage space, which orifice, in the closed position, surrounds only the front end of the applicator tip considered in the direction of the storage space. With such a design the space available for accommodating excess liquid is very sharply defined, and this prevents excessive soiling of the shaft or the application of an excessively large amount of liquid to the applicator tip, which could also lead to difficulties.

In order that the present invention may more readily be understood the following description is given of preferred embodiments thereof, reference being made to the accompanying drawings in which.

In the aerial sectional views of all three embodiments (FIGS. 1, 3 and 5) only the front end 1 of the shaft 2 of the handle is shown in each case, which end encloses an applicator tip 3, especially a fibre tip, having capillary channels.

Figure 1:
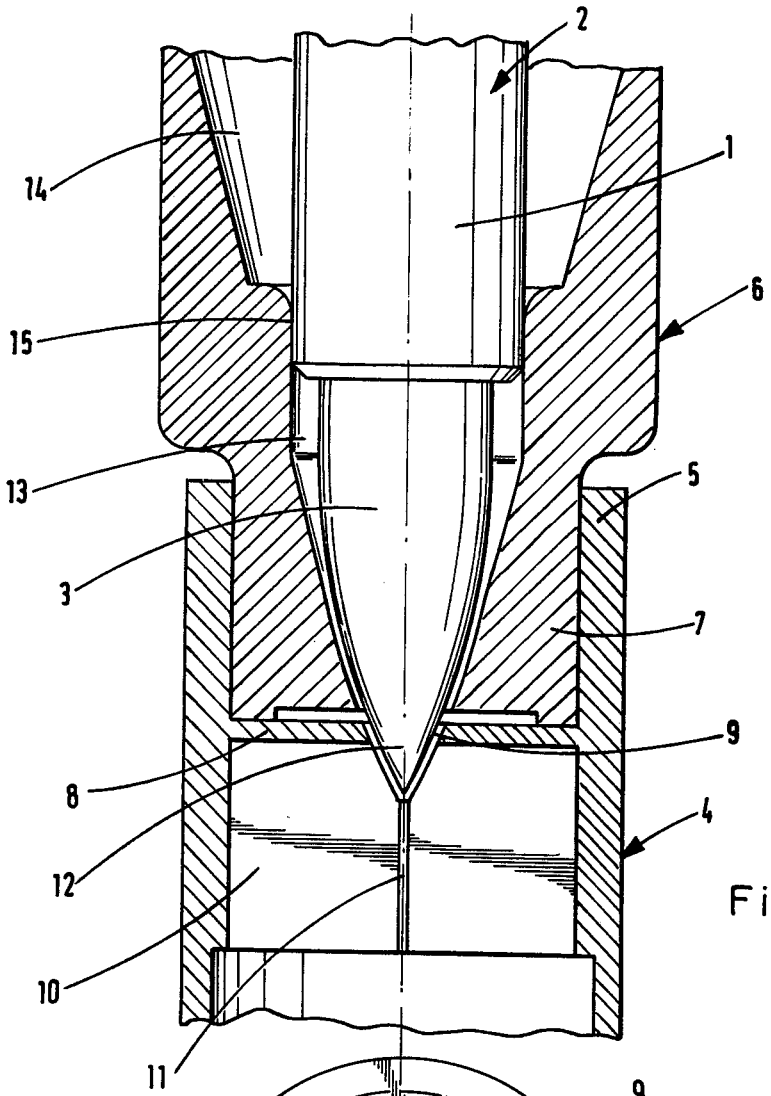
FIG. 1 shows a longitudinal section through a first embodiment of the applicator, in the region of the open end of the liquid container.
Figure 5:
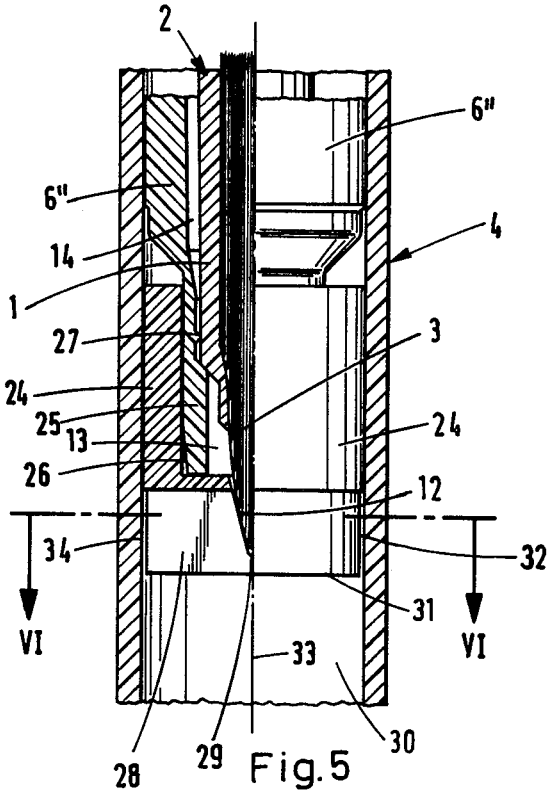
FIG. 5 is an axial section, similar to FIGS. 1 and 3, taken through the liquid container of a third embodiment of the applicator, with fitted handle and applicator tip.

FIGS. 1 and 5 also show a liquid container 4 on the open end 5 of which a connector piece 6 engages. In the embodiment of FIG. 1 the connector piece 6 is moulded with a tapered section 7 which engages on a press fit into the open end 5 of the liquid container 4.

Figure 2:
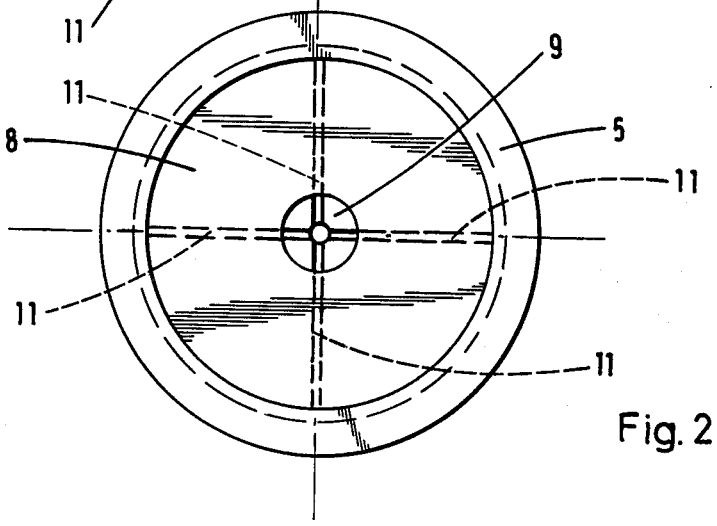
FIG. 2 is a plan view of the open end of the liquid container of FIG. 1, with the connector piece removed.

In the embodiment of FIG. 1, the liquid container 4 also has a separating wall 8 provided with a small orifice 9 for the liquid. On the side towards the interior of the container 4 the separating wall 8 is adjoined by an inset element 10 which, as can be seen in FIG. 2, has capillary channels 11 formed by transverse slots for reliably supplying the applicator tip 3 with the liquid which is preferably pigmented.

In the closed position shown in FIG. 1 the front end 12 of the applicator tip 3 projects through the orifice 9 of the separating wall 8 and into the inset element 10 to draw liquid through the capillary slots 11. This liquid then passes along the capillaries of the fibre tip 3 into the body of the applicator tip 3 which can be extended over an additional distance within the preferably hollow shaft 2.

If, on insertion of the applicator tip 3, to provide the configuration illustrated in FIGS. 1 and 5, the applicator tip 3 no longer contains any liquid, that is to say the applicator has been previously used, only the applicator tip 3 will normally be saturated with liquid. However, if the applicator tip 3 is still partly or completely charged with liquid, as may for example be expected when the applicator tip 3 is repeatedly withdrawn and re-inserted without any special reason, there is the risk that liquid might pass laterally along the applicator tip 3 into the space 13 within the connector piece around the tip 3.

In the known applicators the connector piece 6 was so constructed that the space 13 which surrounds the tip 3 continuously merged into the space 14 surrounding the shaft 2, so in these applicators there was the danger that liquid passing into the space 13, but not taken up by the tip 3, could also run into the space 14 and in doing so soil the outer surface of the shaft 2. This leads naturally to a risk of soiling of the user during use of the instrument.

In order to prevent entry of liquid from the space 13 into the space 14, the connector piece 6 in the illustrative embodiment of FIG. 1 is so constructed as to have an approximately cylindrical inner wall section 15 bearing with sealing effect against the front end 1 of the shaft 2 when the applicator tip 3 is inserted. When the shaft 2 and the connector piece 6 are made of plastics materials, a perfect seal is in general achieved easily by selecting the external diameter of the shaft 2, at least in the region of the front end 1, to be about 0.2 to 0.5 mm greater than the inner diameter of this cylindrical inner wall section 15 of the connector piece 6. With such a selection of dimensions, the shaft 2 can at the same time be easily withdrawn from the connector piece 6 if required.

Figure 4:
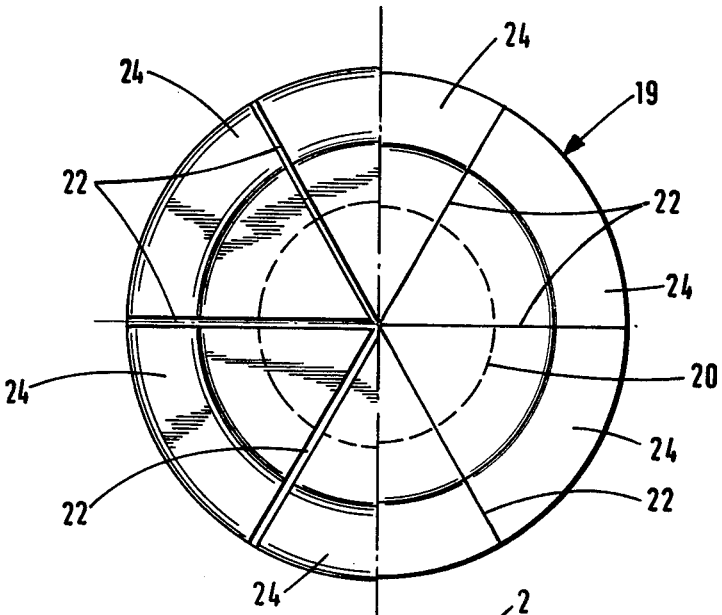
FIG. 4 is an underneath plan view of the closure piece of FIG. 3 (viewed along the direction of arrow IV of FIG. 3)
Figure 3:
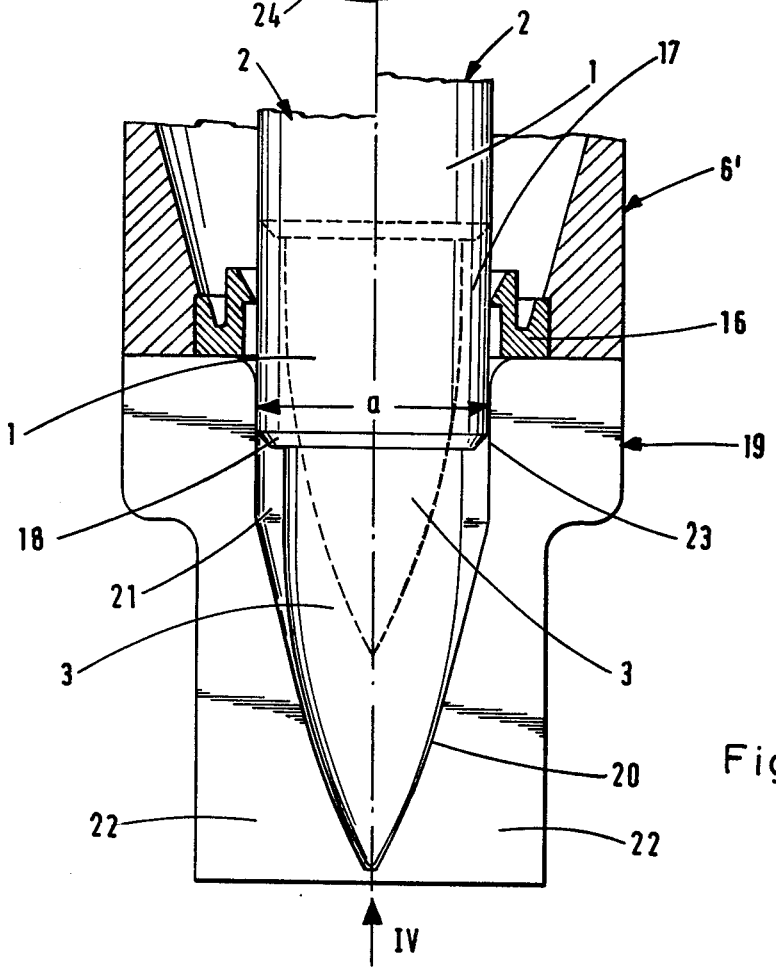
FIG. 3 is a section, similar to that of FIG. 1, taken through the connector piece with adjoining closure element but showing another embodiment of the applicator.

The illustration of the embodiment of FIGS. 3 and 4 differs in several respects from that of FIGS. 1 and 2. First of all the left-hand side of FIGS. 3 and 4 show the condition when the handle is in the closed position, that is to say when the shaft is inserted, whilst the right-hand side in each case shows the condition on removal of the handle with shaft and applicator tip.

In the embodiment of FIGS. 3 and 4 a separately formed collar 16 is provided and is so inserted into the connector piece 6', that it bears with a sealing lip 17 against the shaft 2 in the closed position at a certain distance from the front edge 18 of the shaft. The collar 16, by reason of its construction, and optionally by selection of suitable materials, is relatively easily deformable in order to enable it to bear as precisely as possible against the outer wall of the shaft 2.

In the second embodiment, on that side of the connector piece 6' which faces the liquid container (not shown in FIG. 3), a closure piece 19 is provided which may be integral with the connector piece 6' or may be constructed as a separate part.

The closure piece 19 has approximately centrally a recess 20 which, as in the design of the connector piece 6 in FIG. 1, tapers, in this case approximately conically, in the direction of the liquid container 4. When the shaft 2 with tip 3 is inserted in the connector piece 6 this recess 20 forms a space 21 surrounding the tip 3.

It is furthermore essential that the closure piece 19 is provided with transverse slots 22 which, owing to the elasticity of the material used to manufacture the piece 19, are normally, that is to say when the shaft 2 is withdrawn, closed (FIGS. 3, 4 right-hand side). However, the transverse slots 22 can be spread apart by bringing the shaft 2 into the closed position, as shown on the left-hand side of FIGS. 3 and 4, and form in this case, as can be best seen in FIG. 4, capillary channels for conveying the liquid from the liquid container towards the tip 3.

This opening of the channels 22, when the shaft 2 is in the closed position, is achieved by giving the front end 1 of the shaft 2 a somewhat greater diameter than the internal diameter *a* of the approximately cylindrical section 23 of the wall of the recess 20. If in this case the front end 1 of the shaft 2 is pressed into the cylindrical region 23 of the recess 20, then the surfaces 24 bounding the transverse slots 22 are understandably pressed away from each other, out of the closed position which they normally assume, into the open position where they define the capillary channels.

Thus, when the closure piece 19 of FIGS. 3 and 4 is present, not only is soiling of the shaft 2 in the rear region prevented from the outset by the collar 16, but in addition entry of liquid into the space 21 accommodating the tip 3 is absolutely prevented because the liquid container is fully sealed off by the closure piece 19 when the handle element is taken off.

Reliable opening and closing of the slots 22 can, for example, be achieved if, with the normal shaft diameters of a few millimeters, the diameter a of the cylindrical section 23 is about 0.2 to 0.5 mm smaller than the external diameter of the end 1 of the shaft 2.

Figure 6:
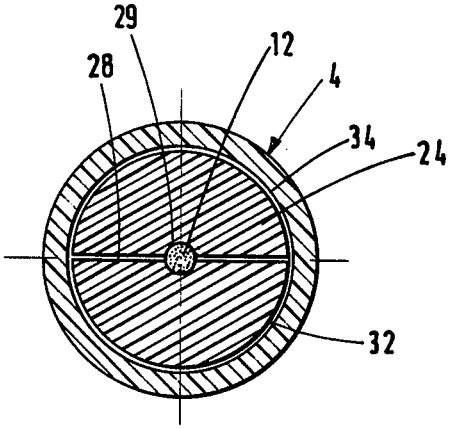
FIG. 6 is a section taken on the line VI-VI of FIG. 5.

The illustrative embodiment shown in FIGS. 5 and 6 also comprises an inset element 24, which is arranged in the liquid container 4 within the connector piece 6''. Here, the design is such that the connector piece 6'' engages with an extension 25 into a recess 26 of the inset element 24. The extension 25 carries, on the inside, an annular bead 27, which serves as a collar bearing with sealing effect on the shaft 2 of the applicator tip 3.

The particular attraction of the embodiment of FIGS. 5 and 6 is seen essentially in the design of the inset element 24. As shown clearly, in particular in FIG. 6, this element in fact has merely one diagonally extending transverse slot 28, which connects the recess 29 accommodating the front end 12 of the applicator tip 3 with that end face 31 of the inset element 24 which is oriented towards the interior 30 of the liquid container 4. The diagonally extending transverse slot 28 again has capillary dimensions relative to the viscosity of the liquid present in the liquid container 4.

Moreover the applicator of FIGS. 5 and 6 has an annular gap 32 provided around the periphery of the inset element 24 on that side of the inset element which is oriented towards the interior 30 of the liquid container 4. As FIG. 6 clearly shows, this annular gap 32, between the periphery of the inset element 24 and the surrounding inner face 34 of the container 4, extends approximately concentrically to the axis 33 of the inset element. It communicates with the transverse slot 28 and has likewise capillary dimensions relative to the viscosity of the liquid present in the container 4. In the embodiment shown, the annular gap 32 is open in the direction of the interior 30 of the fiquid container 4 and is bounded by a peripheral groove of the inset element 24 as well as by the inner face 34 of the container 4.

The purpose of this annular gap 32 is to ensure a reliable feed path for the liquid from the liquid container 4 to the transverse slot 28 and thus to the free end 12 of the applicator tip 3, even in the case where only a very small amount of liquid is present in the liquid container 4. If, in this event, the applicator is laid flat, i.e. tilted by about 90° from the position shown in FIG. 5, it is thus ensured that liquid will pass into the region of the annular gap 32, from which it is conveyed, under capillary action, through the transverse slot 28 to the recess 29 for the free end 12 of the applicator tip 3.

As already mentioned, in the applicator according to the invention the collars 15, 17 and 27 ensure that no liquid passes from the space 13 in the region of the end of the shaft 2 into the space 14 located further towards the rear of the applicator tip. Furthermore, since the transverse slots 11, 22 or 28 have only capillary dimensions, emergence of liquid from the liquid container 4 through the inset element 24 or through the closure pieces 10, 19 will be prevented. However, a reliable conveying of liquid to the free end 12 of the applicator tip 3 is nevertheless achieved by the capillary slots 11, 22, 28.

We claim

1. An applicator for a liquid product, including a container open at one end; a handle adapted to be fitted on said open end of the container to close it; a shaft connected to said handle, an applicator tip at that end of said shaft which in a closed position of the applicator faces the container and adapted to project into the container; means defining capillary channels in said applicator tip; means mounting said applicator on said shaft to project from the free end of said shaft; an inset element in the container at said open end thereof, means on said inset element defining an approximately central recess for accommodating said applicator tip in the closed position; and transverse slot means on said inset element and extending in the axial direction and forming capillary channels which connect the interior of the container with said recess for the applicator tip, whereby a liquid product in the container will enter said capillary channels and be guided into communication with said applicator tip.

2. An applicator according to claim 1, wherein said inset element is a closure emember made of elastically deformable material and said at least one transverse slot is normally closed but formed such that when said applicator tip is inserted in said central recess of said closure member said slot means will be expanded into an open configuration and that when the applicator tip is withdrawn said slot means will contract to said normally closed configuration.

3. An applicator according to claim 1, wherein on its side facing towards the interior of the container, said inset element is provided with means defining an annular capillary gap which extends approximately concentrically to the axis of the inset element, and communicates with said transverse slot means.

4. An applicator according to claim 3, wherein said inset element includes a peripheral groove which is open to the interior of the liquid container and bounds said annular gap, and said container has an inner wall which further bounds said annular gap.

5. An applicator according to claim 1, and including a collar at said open end of the liquid container and adapted to bear sealingly on said shaft in the vicinity of its free end when said applicator tip is inserted into said recess.

6. An applicator according to claim 5, including a connector piece for connecting the handle and the container and projecting outwardly of the container at its open end, and an approximately cylindrical inner wall section forming said collar.

7. An applicator according to claim 5, including a connector piece serving to connect the handle and the container and adapted to receive in said collar, and a sealing and wiper lip formed on said collar and oriented towards said shaft, said collar being made of elastically deformable material.

8. An applicator according to claim 6, wherein said connector piece includes means defining an inner space tapering approximately conically from the collar to the interior of said container, and an orifice at one end of said inner space for connecting the inner space with the interior of said container and surrounding only the front end of the applicator tip when the applicator is in the closed configuration.

* * * * *